United States Patent [19]

Sprankle

[11] 3,977,818

[45] Aug. 31, 1976

[54] THROTTLING MEANS FOR GEOTHERMAL STREAMS

[75] Inventor: Roger S. Sprankle, Mission Viejo, Calif.

[73] Assignee: Hydrothermal Power Co., Ltd., Pasadena, Calif.

[22] Filed: Jan. 17, 1975

[21] Appl. No.: 541,854

[52] U.S. Cl. ..... 418/201; 60/641

[51] Int. Cl.[2] ..... F01C 1/16; F01C 21/12; F03G 7/04

[58] Field of Search ..... 418/201, 203, 202; 60/641

[56] References Cited

UNITED STATES PATENTS

| | | | |
|---|---|---|---|
| 3,108,739 | 10/1963 | Nilsson et al. | 418/201 X |
| 3,108,740 | 10/1963 | Schibbye | 418/201 |
| 3,151,806 | 10/1964 | Whitfield | 418/201 X |
| 3,307,453 | 3/1967 | Wilsson | 418/201 X |
| 3,656,876 | 4/1972 | Kocher | 418/201 X |

*Primary Examiner*—C. J. Husar
*Assistant Examiner*—Leonard Smith
*Attorney, Agent, or Firm*—Donald D. Mon

[57] ABSTRACT

A helical screw expander for deriving energy from geothermally heated water. The expander includes a pair of helical rotors with helical structures fitted in an expansion chamber. The geothermally heated water is introduced into said chamber through a throttle port located at an end face of the expansion chamber, whereby precipitation which occurs as a consequence of reduction of pressure and temperature is formed in the expansion chamber where the helical rotors dispose of it. The throttle is preferably adjustable, and also preferably forms a substantially isentropic converging nozzle which discharges fluid at the helical structures.

8 Claims, 8 Drawing Figures

FROM WELL 43
TO SUMP 41
GEN 32

THROTTLING MEANS FOR GEOTHERMAL STREAMS

This invention relates to improvements in helical screw expanders, which improvements are especially useful when the helical screw expander is put to use as motive means for power production in the course of utilizing geothermally heated water as a source of power.

A major proportion of the world's geothermal fields are liquid-dominated. By this it is meant that they do not deliver steam, but instead deliver superheated water, much of which is hot brine that bears a considerable burden of dissolved minerals. The dissolved mineral concentration is high because of the elevated temperature and pressure of the water underground, and tends to be at or near chemical saturation because of the long residence of the water in the mineral deposit. When the water is released from the well and pressure and temperature are reduced, there is an immediate precipitation of minerals. The amount of precipitate is so great as to clog up and disable most prior art power systems in a very short period of time.

In particular, heat exchanger techniques which have sought to heat-transfer the energy through heat exchangers have clogged up very swiftly. Flash steam systems are also known. These involve seperators that throttle the hot brine to flash and then separate the steam phase for use in steam turbines. These systems also clog up very swiftly.

As a consequence, prior to the invention described in Sprankle U.S. Pat. No. 3,751,673, issued Aug. 7, 1973, it was commercially practical to derive energy only from those geothermal fields which were not liquid-dominated; that is, those which delivered live steam substantially without mineral content, and the efficient extraction of energy from liquid-dominated geothermal fields was a practical impossibility. Those systems which did exist to work on liquid-dominated geothermal fields soon clogged up, or if they did not clog up, they had to discard considerable energy in the form of hot water which the Sprankle system can put to use.

The Sprankle system utilizes a helical screw expander which in operation continuously rids itself of deleterious precipitated minerals. The minerals which do remain in the helical screw expander actually improve the efficiency of the expander by forming a seal between its moving surfaces.

It should be borne in mind that precipitation will not occur in the well liquid until its pressure or temperature (or both) are reduced. Therefore, it is advantageous to maintain full system pressure all the way to the expander. However, this leaves the problem of how to regulate the motive fluid to the expander so as to establish its rates of operation. Throttles have heretofore been placed upstream of the expander, and as can reasonably be predicted, they cause precipitation in the line and also loss of kinetic energy.

It is an object of this invention to provide throttling means (either adjustable or fixed) for throttling the flow of liquid to a helical screw expander wherein the precipitation, which occurs as the consequence of the pressure drop at the throttle, takes place where the helical screw is able to dispose of the precipitate. In addition, the throttle can conveniently be shaped so as to cause the stream to be accelerated and improve the kinetic efficiency of its impingement upon the helical rotors.

A device according to this invention comprises a conventional helical screw expander having a pair of mating helical rotors which drive shafts, at least one of which is adapted to drive a generator for generating the electricity. The helical rotors are contained in an expander chamber bounded by a chamber wall, there being a throttle port and an outlet port through the wall at opposite ends of the helical screws. According to a feature of the invention, a throttle member is so disposed and arranged as to form a part of said wall of the expander chamber, whereby the change of conditions in the liquid stream which cause mineral deposition occur within the expander chamber.

According to a preferred but optional feature of the invention, the throttle comprises a nozzle member which directs its stream at a working face of the helical rotors.

The above and other features of this invention will be fully understood from the following detailed description and the accompanying drawings, in which.

Figures 1, 5:
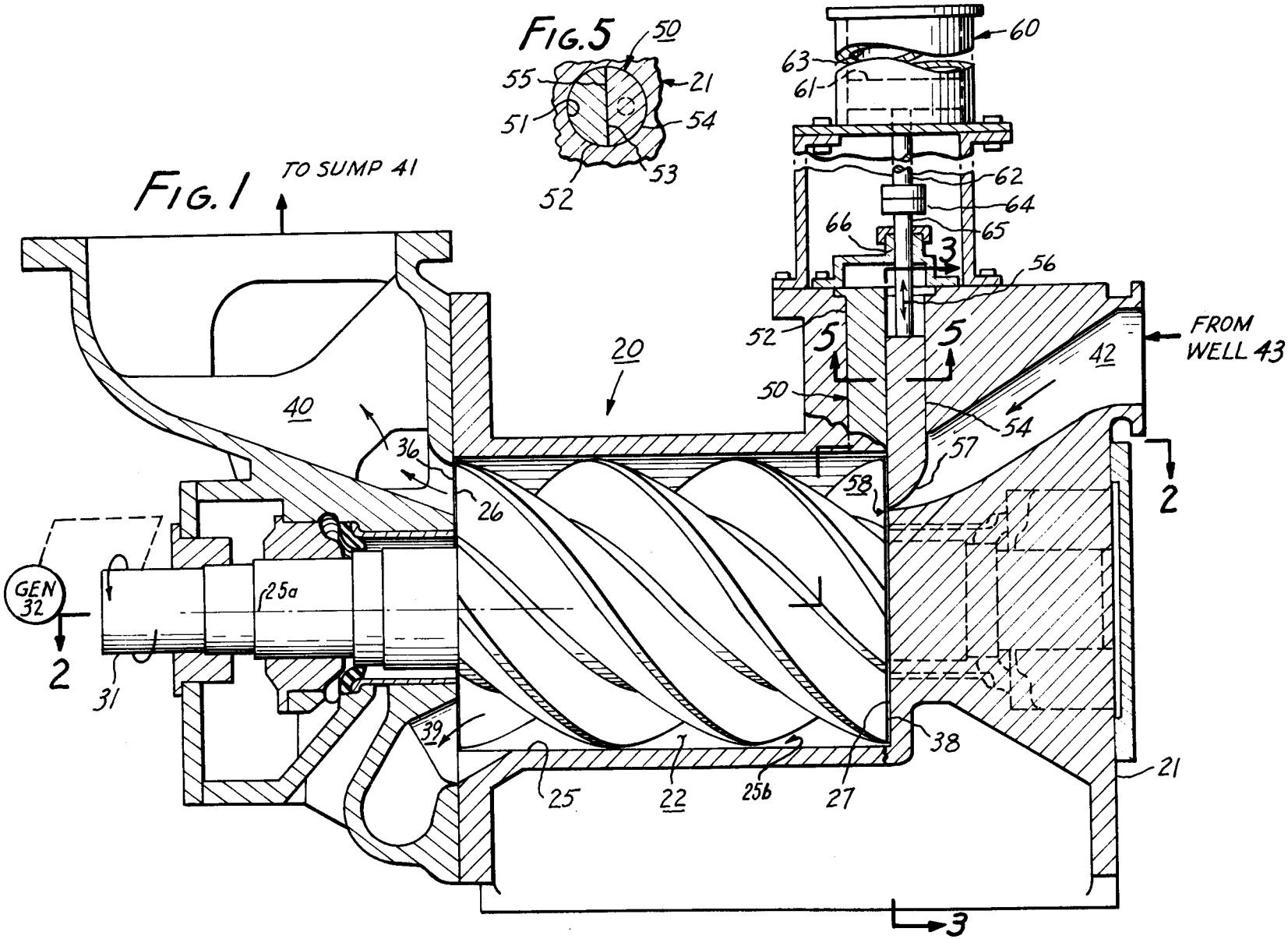
FIG. 1 is a side elevation, partly in cutaway cross-section, of a helical screw expander incorporating a throttle according to the invention.
FIG. 5 is a cross-section taken at line 5—5 of FIG. 1.

Reference is hereby made to Sprankle U.S. Pat. No. 3,751,673, issued Aug. 7, 1973, which is incorporated herein by reference. The said Sprankle patent is hereby relied on for its disclosure of the use of a helical screw expander to extract energy from geothermally heated water and produce power, for example by driving an electrical generator. It is further relied on for its showing of construction details of a helical screw expander. It is unnecessary to an understanding of the instant invention fully to discuss here the details of operation of helical screw expanders, which are well disclosed in the Sprankle patent. It may briefly be stated that the helical screw machine (Lysholm Machine) is well known for its operation as a gas compressor or expander.

As a brief summary, which may be useful to an understanding of the details of this invention, it is stated that a rotary screw expander 20 (FIG. 1) includes a block 21 which encloses an expander chamber 22. The expander chamber has a pair of cusps 23, 24 which are bounded by an axially-extending portion of 25a chamber wall 25b (extending parallel to axis 25a). A pair of end faces 26, 27 form part of the chamber wall. The chamber houses a pair of mating helical rotors 28, 29.

The rotors include respective shafts 30, 31 which are journaled in the block, at least one of which (shaft 31) extends beyond the block where it is connected to an electrical generator 32 for generating electricity. The helical rotors include helical structures 33, 34 which make a relatively close fit with the chamber wall and mesh with each other. The rotors have end faces 35, 36, 37 and 38. End faces 35, 36 are planar and in near adjacency to end face 26 which also is planar. End faces 37, 38 are also planar and in substantial adjacency to end face 27, which also is generally planar.

Figure 3:
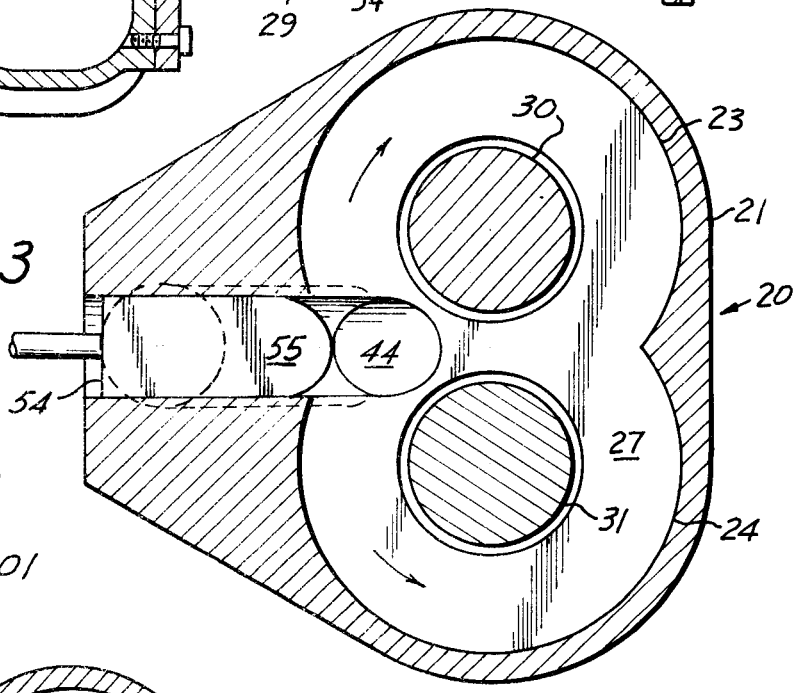
FIG. 3 is a cross-section taken at line 3—3 of FIG. 1.
Figure 4:
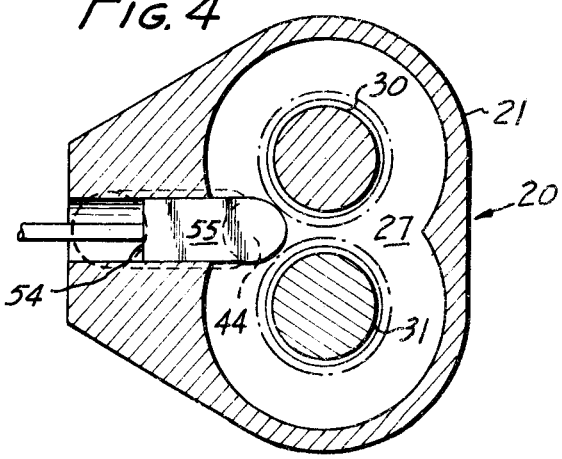
FIG. 4 is a cross-section similar to FIG. 3 showing a portion thereof in another operating position.

End face 26 is at the exhaust end of the expander chamber. An exhaust port 39 is formed in end face 26 which connects to an exhaust passage 40 that in turn discharges to sump 41. A supply passage 42 which receives hot water from well 43 is formed in the block. A throttle port 44 (FIGS. 3 and 4) is formed in end face 27 at the downstream end of the supply passage.

Figure 2:
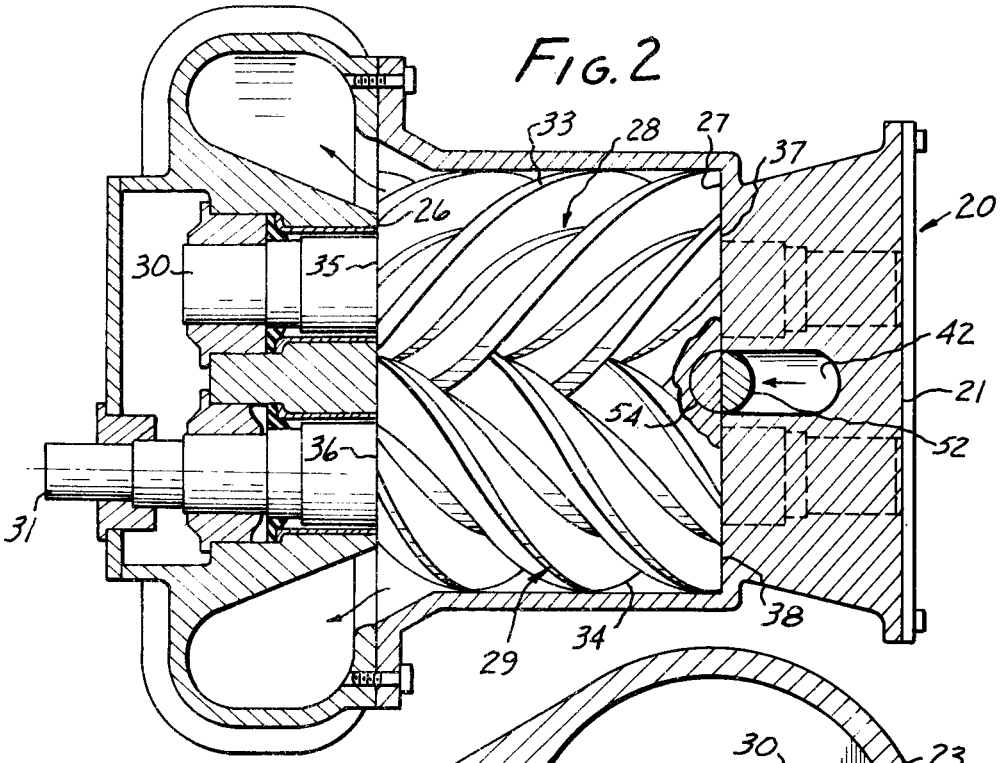
FIG. 2 is a composite section taken at line 2—2 of FIG. 1.

An examination of FIGS. 1 and 2 will show that the outer edges of the helical structures and the end faces of the helical rotors operate in close adjacency to the axially extending portion of the chamber wall and to its end faces. Although the helical rotors can serve to drive each other by direct contact, the more conventional practice is to gear them together by timing gear means (not shown). The timing gears serve to synchronize the rotation of the rotors and prevent their bearing directly against one another. Whether timing gears are used or not, but especially when they are used, precipitate will soon deposit on them and fill the clearance between them. This deposit will be continually lapped by the action of the rotors. It forms a useful and effective seal between them. The outer edges of the helical structures scrape excess precipitate off the axially extending portion of the chamber wall, and the end faces of the helical structures scrape excess off the end faces of the expander chamber. As a consequence, it is unnecessary to machine the structures to close tolerances.

A throttle 50 according to the invention is formed in the block near the right-hand (upstream) end of the expander chamber in FIG. 1. Best practice according to the invention is to place the throttle where a portion of it forms a continuation of end face 27, and this is shown in the drawings. As can best be seen in FIGS. 1 and 5, a bore 51 is formed in the block whose centerline is coincident with the plane of end face 27. A filler block 52, which is a halfsection of a cylinder, fills one-half of bore 51, and it has a planar face 53 which is coplanar with end face 27.

A throttle block 54 comprises an axial half-cylinder which, with block 52, fills bore 51. It has a planar face 55 which is contiguous with planar face 53 so as to form a shear-seal interface with it. Faces 53 and 55 are both coplanar with end face 27.

It will thereby be seen that the throttle block may be moved bi-directionally, as shown by arrow 56, so as adjustably to open and to close supply passage 42 at throttle port 44. Planar face 55 is reacted upon by the end faces 28 and 29 of the rotors so as to maintain its surface as free of precipitate as end face 27.

A nozzle face 57 on the upstream side of the throttle block is curved as shown in FIG. 1 so as to constitute at least an approximation to the correct profile for isentropic expansion of fluids passing it. This nozzle face and the wall of the supply passage 42 immediately adjacent to the throttle port together form a nozzle 58 which directs the stream from the supply passage for direct impingement upon the helical rotors, so as to take advantage of the kinetic energy of the stream.

Examination of the Figs. will show that the smallest possible opening in the inlet system to the expander chamber is at the throttle port 44 in the end face of the chamber, regardless of the setting of the throttle. The cross-section area of the conduitry upstream of the throttle port 44 is therefore never smaller than the cross-section area of the port. For this reason, precipitation will not form upstream of the throttle port, but instead in the expander chamber where the rotors can grind it up.

It is best practice for surface 51 to be planar, and the lower edge of it at the nozzle will be coplanar with face 27, in order to define the nozzle. However, at elevations above the lower margin, some divergence from planar can be accepted, and some offset from coplanar with face 27 also, because the nozzle would still be properly defined. However, there might be a less effective removal of precipitate from surface 51, although this might not be excessively deleterious.

The throttle block is moved by means of a motor 60 which may conveniently be a fluid motor, such as a piston-cylinder type, including a piston 61, a piston rod 62 and cylinder 63. The piston rod is connected by connector 64 to drive rod 65 which passes through a seal system 66. The motor is an optional feature. It may be that in some well installations the conditions will be sufficiently understood and constant that a permanent non-adjustable throttle arrangement can be used, and such an arrangement is contemplated in this invention. However, in most practical well systems, some means for adjusting the size of the throttle opening by moving the block will be provided. The mobility of the throttle block may be assured by packing its surroundings with some kind of grease, such as a teflon-type, high-temperature grease. Also, the actuating cylinder may be made large enough to exert sufficient force to shear and thereby overcome the resistance of any precipitate deposits which might deposit between the moving parts.

Figure 6:
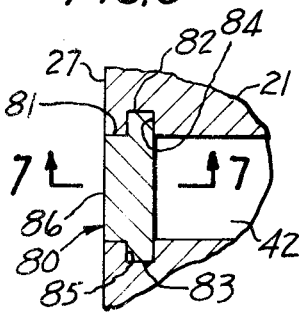
FIG. 6 is a fragmentary cross-section of another embodiment of a throttle according to the invention.
Figure 7:
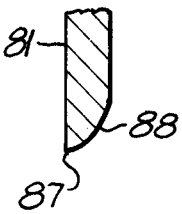
FIG. 7 is a fragmentary cross-section taken at line 7—7 of FIG. 6.

FIGS. 6 and 7 show a throttle block 80 which can be used instead of throttle 50. Instead of being formed as a half-cylinder in its upper regions, it is instead formed as a plate or bar 81, having a pair of keys 82, 83 vertically slidable in byways 84, 85 in block 21. The key-keyway combination enables bar 81 to move up and down across the throttle port 44.

Bar 81 includes a face 86 (at least contiguous to its lower edge) which is substantially coplanar with end face 27. Preferably, the entire left-hand side of the bar, as viewed in FIG. 6, is coplanar with face 27. The lower tip 87 of the bar is shaped the same as that of throttle block 50. The upstream nozzle face 88 is shaped the same as nozzle face 57 in FIG. 1, and for the same reason. FIGS. 6 and 7 serve to illustrate that the throttle blocks may be made in different configurations.

This invention thereby provides a throttle which may or may not be made adjustable, which can deliver an optimum impinging stream on the rotor, which will cause deposition only within the expander chamber, and, in the preferred construction, whose parts constitute either a portion of a nozzle or the continuation of an end face which is swept by the rotor, or both.

Figure 8:
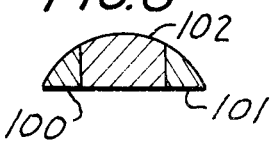

The machine can be made useful on wells of widely varying pressures and flow rates simply by modifying the throttle block so as to suit its width to the formation of different nozzle sizes. For example, in FIG. 8, two stationary filler blocks 100, 101 abut a movable throttle block 102. Together, blocks 100, 101, and 102 equal in cross-section that of throttle block 54 in FIG. 1. The variation in the width directly varies the throttle port area for each axial setting of the throttle block. The same division of the throttle block into a plurality of parts can be made in the device of FIGS. 6 and 7.

This invention is not to be limited by the embodiments shown in the drawings and described in the description, which are given by way of example and not of limitation, but only in accordance with the scope of the appended claims.

I claim:

1. A helical screw expander for deriving energy from geothermally heated water, comprising: a block enclosing an expander chamber; a chamber wall having an axis and including an axially-extending portion and a pair of planar end faces, said portion and said end faces defining said expander chamber; a pair of mating helical rotors extending axially and side-by-side in said expander chamber, each helical rotor including a helical structure which moves in adjacency to the axially-extending portion, and further including a pair of end faces, each of which moves in adjacency to a respective end face of the chamber wall; an exhaust port opening into one end face of the expander chamber; an exhaust passage extending through the block and opening into the exhaust port; a throttle port in the other end face of the expander chamber; a supply passage extending through the block and opening into the throttle port; an adjustably movable throttle block forming together with the wall of the supply passage an adjustable nozzle which terminates at the respective end face of the expander chamber and is so proportioned and and arranged as to direct a stream of liquid from the supply passage to impinge onto a helical structure whereby to impart kinetic energy to said helical structure and assist in rotating it, the cross-section of the throttle, at the throttle port, being the least cross-section of the supply passage; and means to move the throttle block and thereby adjust the size of the nozzle.

2. A helical screw expander according to claim 1 in which a face on said throttle block adjacent to the throttle port is substantially coplanar with the end face in which the throttle port is formed.

3. A helical screw expander according to claim 2 in which the throttle block and the block of the expander carry interengaging keys and keyways to restrain the throttle block against the flow of fluid and to guide the throttle block.

4. A helical screw expander according to claim 1 in which the throttle block includes an upstream nozzle face which, together with that part of the wall of the supply passage which is located immediately adjacent to the throttle port, forms the nozzle.

5. A helical screw expander according to claim 4 in which motor means is provided to move the throttle block.

6. A helical screw expander according to claim 4 in which a face on said throttle block adjacent to the throttle port is substantially coplanar with the end face in which the throttle port is formed.

7. A helical screw expander according to claim 4 in which the nozzle is a substantially isentropic converging nozzle.

8. A helical screw expander according to claim 7 in which a face on said throttle block adjacent to the throttle port is substantially coplanar with the end face in which the throttle port is formed.

* * * * *